US007061453B2

(12) United States Patent
Senda et al.

(10) Patent No.: US 7,061,453 B2
(45) Date of Patent: Jun. 13, 2006

(54) ACTIVE MATRIX EL DISPLAY DEVICE AND METHOD OF DRIVING THE SAME

(75) Inventors: Kouji Senda, Nagaokakyo (JP); Yutaka Nanno, Takarazuka (JP); Hiroshi Tsutsu, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 315 days.

(21) Appl. No.: 10/481,898

(22) PCT Filed: Jun. 26, 2002

(86) PCT No.: PCT/JP02/06389

§ 371 (c)(1),
(2), (4) Date: Dec. 23, 2003

(87) PCT Pub. No.: WO03/003339

PCT Pub. Date: Jan. 9, 2003

(65) Prior Publication Data

US 2004/0196218 A1 Oct. 7, 2004

(30) Foreign Application Priority Data

Jun. 28, 2001 (JP) ..... 2001-195774

(51) Int. Cl.
*G09G 3/30* (2006.01)

(52) U.S. Cl. ..... 345/76; 345/77

(58) Field of Classification Search ..... 315/169.1, 315/169.2, 169.3, 169.4, 224, 291; 345/36, 345/45, 76, 77, 84, 204
See application file for complete search history.

(56) References Cited

U.S. PATENT DOCUMENTS 4,996,523 A 2/1991 Bell et al.
6,020,865 A 2/2000 Okuda et al.
6,069,609 A 5/2000 Ishida et al.
6,091,203 A 7/2000 Kawashima et al.
6,774,877 B1 * 8/2004 Nishitoba et al. ..... 345/76
6,806,857 B1 * 10/2004 Sempel et al. ..... 345/92
2002/0021274 A1 2/2002 Koyama et al.
2002/0158855 A1 10/2002 Matsueda (Continued)

FOREIGN PATENT DOCUMENTS

JP 6-161385 6/1994

(Continued)

*Primary Examiner*—Vijay Shankar
*Assistant Examiner*—Nitin Patel
(74) *Attorney, Agent, or Firm*—Hamre, Schumann, Mueller & Larson, P.C.

(57) ABSTRACT

A unit pixel (10) includes a plurality of current controlling elements (Tr2*a*–Tr2*d*) having controlling terminal and connected to a single EL element (11), and switching elements (Tr1*a*–Tr1*d*) provided to the respective current controlling elements in order to switch between application and cutoff of a digital image signal with respect to the controlling terminals in accordance with the condition of a scanning signal. Each of the current controlling elements is controlled by a voltage of the digital image signal so as to take an OFF state for cutting off a supply of a driving current to the EL element or an ON state for supplying the EL element with a driving current corresponding to the voltage of the digital image signal, and a value of the current flowing in the EL element is the sum value of currents supplied from the respective current controlling elements in the ON state. Based on a combination of the current controlling elements in the ON state, the current supplied to the EL element is controlled to be a value corresponding to the gradation.

15 Claims, 14 Drawing Sheets

U.S. PATENT DOCUMENTS

| | | | | |
|---|---|---|---|---|
| 2004/0145597 | A1* | 7/2004 | Ito | 345/690 |
| 2005/0057459 | A1* | 3/2005 | Miyazawa | 345/76 |
| 2006/0028409 | A1* | 2/2006 | Numao | 345/76 |

FOREIGN PATENT DOCUMENTS

| | | |
|---|---|---|
| JP | 8-95522 | 4/1996 |
| JP | 8-106075 | 4/1996 |
| JP | 8-129359 | 5/1996 |
| JP | 8-286634 | 11/1996 |
| JP | 9-16123 | 1/1997 |
| JP | 9-114414 | 5/1997 |
| JP | 10-254410 | 9/1998 |
| JP | 2000-235370 | 8/2000 |
| JP | 57-128394 | 8/2002 |

* cited by examiner

| Assigning intensity levels | | Driving transistor | | | |
|---|---|---|---|---|---|
| | | Tr2a | Tr2b | Tr2c | Tr2d |
| | 0 | 0 | 0 | 0 | 0 |
| Dark | 1 | 1 | 0 | 0 | 0 |
| ↑ | 2 | 0 | 1 | 0 | 0 |
| | 3 | 1 | 1 | 0 | 0 |
| | 4 | 0 | 0 | 1 | 0 |
| | 5 | 1 | 0 | 1 | 0 |
| | 6 | 0 | 1 | 1 | 0 |
| | 7 | 1 | 1 | 1 | 0 |
| | 8 | 0 | 0 | 0 | 1 |
| | 9 | 1 | 0 | 0 | 1 |
| | 10 | 0 | 1 | 0 | 1 |
| | 11 | 1 | 1 | 0 | 1 |
| | 12 | 0 | 0 | 1 | 1 |
| ↓ | 13 | 1 | 0 | 1 | 1 |
| Bright | 14 | 0 | 1 | 1 | 1 |
| | 15 | 1 | 1 | 1 | 1 |

FIG. 5

ACTIVE MATRIX EL DISPLAY DEVICE AND METHOD OF DRIVING THE SAME

TECHNICAL FIELD

The present invention relates to an active matrix EL display device used in so-called portable equipment or the like, and a method of driving the device.

BACKGROUND ART

FIG. 12 shows a configuration of a conventionally-typical active matrix EL display device 101. The numeral 102 denotes a unit pixel contained in the active matrix EL display device 101. Though unit pixels 102 are arrayed in a matrix in an actual device, only one unit pixel is shown here for the sake of clarity. The unit pixel 102 includes an EL element 103, a driving transistor 104 connected to one end of the EL element 103, a switching transistor 105 connected to a gate of the driving transistor 104, and a capacitor 106. To a gate of the switching transistor 105, a scanning signal is supplied from a scanning-driving circuit 108 through a scanning line 107. To the gate of the driving transistor 104, an image signal is supplied from a signal-driving circuit 110 via the switching transistor 105 and a signal line 109. To the EL element 103, a current is supplied from a current supply circuit 112 via the driving transistor 104 and a current supply line 111.

A light emission operation of this EL display device 101 will be described below. First, when both the scanning line 107 and the signal line 109 are turned on, electric charge is stored in the capacitor 106 through the switching transistor 105. Subsequently, since this capacitor 106 continues to apply voltage to the gate of the driving transistor 104, the current continues to flow into the EL element 103 from the current supply circuit 112 via the current supply line 111 even when the switching transistor 105 is turned off, and thus light emission and driving are carried out based on the electric current corresponding to the current image signal until an image signal is rewritten in the next field.

In a case of displaying gradation by means of the conventional active matrix EL display device, it is possible to apply to the gate of the driving transistor 104 a voltage corresponding to the gradation so as to vary the ON current analogically. In this case, the variation in the ON current of the driving transistor 104 affects the display. The ON current of the transistor is extremely uniform for a transistor composed of single crystal. However, in a transistor formed with a low-temperature polysilicon that can be formed on an inexpensive glass substrate, the threshold value has a variation in a range of ±0.2 V to 0.5 V. As a result, the ON current flowing in the driving transistor 104 varies corresponding thereto, resulting in unevenness in the display. Variation in the ON current may be caused not only by the variation in the threshold voltage but also by variation in the mobility in TFT, variation in thickness of a gate insulating film, or the like. Therefore, in the above-described method of displaying the gradation analogically, their properties must be controlled strictly. However, this is difficult with the low-temperature polysilicon TFT in present use.

An area gradation display method is suggested for solving this problem. This method includes forming, within a unit pixel configuring an active matrix EL display device, a plurality of EL elements and a plurality of thin film transistors for supplying current to the respective EL elements, and controlling by the thin film transistors the number of EL elements to emit light in accordance with the gradation.

According to this configuration, the variation in the thin film transistor properties will not appear as a variation in the brightness of the EL elements, providing an accurate gradation in display.

However, when the area gradation display method is used for displaying by means of an active matrix EL display device, a fixed pattern is generated on the display image, and thus the image quality deteriorates.

DISCLOSURE OF INVENTION

In view of the above-described problems, an object of the present invention is to provide an active matrix EL display device that can provide an accurate gradation display, without causing a fixed pattern, and also a method of driving the same.

An active matrix EL display device according to the present invention includes a plurality of unit pixels arrayed in a matrix. Each of the pixels has an EL element that is supplied with a driving current on the basis of scanning signals and digital image signals, so as to emit light and display an image. For achieving the object, the unit pixel includes a plurality of current controlling elements that have controlling terminals to which the respective digital image signals are applied and that are connected to a single EL element, and switching elements that are provided corresponding to the respective current controlling elements and supplied respectively with the scanning signals so as to switch between application and cutoff of the digital image signals with respect to the controlling terminals in accordance with the states of the scanning signals. Each of the current controlling elements is controlled by a voltage of the digital image signal applied to the control terminal so as to achieve an OFF state for cutting off a supply of the driving current to the EL element or an ON state for supplying the EL element with the driving current corresponding to the voltage of the digital image signal, thereby a value of the current flowing in the EL element becomes the sum value of currents supplied from the respective current controlling elements in the ON state. And, based on a combination of the current controlling elements in the ON state, the current supplied to the EL elements is controlled to be a value corresponding to the gradation to be displayed.

According to this configuration, since the current value supplied to a single EL element is controlled by a plurality of current controlling elements so as to carry out a gradation display, fixed patterns will not be generated, and a gradation display can be performed accurately in comparison with a case of varying the current value analogically by using a single current controlling element.

It is preferable in the configuration that the current driving ability of each of the current controlling elements is set to correspond to weighting of the respective bits of the digital image signals. Thereby, the control for the gradation display can be performed with a simple configuration. More preferably, the number of the current controlling elements in the unit pixels is set to be identical to the number of bits of the digital image signals.

In the above-described configuration, the current controlling elements may be made as thin film transistors. The thin film transistors may be formed with polycrystalline silicon. By performing the accurate gradation display as mentioned above, excellent gradation display is available even by using polycrystalline silicon having a threshold value with a large variation.

In the configuration, the current driving ability X of the thin film transistors may be set on the basis of a relationship represented by the following formula:

$$X=(a\cdot W)/L.$$

In the formula, 'a' denotes a constant, L denotes the gate length (μm) of the thin film transistors, and W denotes the gate width (μm) of the thin film transistors.

In the configuration, it is preferable that either the gate width W or the gate length L of the thin film transistors is set to be a size corresponding to the weighting of the respective bits of the digital image signals.

Preferably in the configuration, an auxiliary capacitor is connected to a controlling terminal of the current controlling element. For example, the auxiliary capacitor is formed between the controlling terminal of the current controlling element and a scanning line in either a preceding or a succeeding column among the plural scanning lines for supplying the scanning signals. Alternatively, when there is a dedicated current-supply bus line for supplying a driving current to the EL element through the current controlling element, an auxiliary capacitor will be formed between the controlling terminal of the current controlling element and the bus line for exclusively supplying a current.

Connecting a capacitor to the controlling terminal of the current controlling element will provide an effect of suppressing fluctuation in potentials of the current controlling elements, which are caused by leakage in the switching element.

In the above configuration, each of the current controlling elements can be connected, at an end other than the end connected to the EL element, to a scanning line for supplying the scanning signals, and the scanning line is configured to be used also as a current supply line for supplying a driving current to the EL element via the current controlling element.

Alternatively, the respective current controlling elements can be connected to the scanning lines corresponding to the current controlling elements.

By supplying a current from the scanning line to the EL element, a dedicated current supply line for supplying current to the EL element can be omitted. As a result, the numerical aperture can be increased and the occurrence of an interlayer short-circuit caused by the current supply line can be prevented, thereby providing a matrix EL display device that can improve the yield.

A method of driving an active matrix EL display device according to the present invention includes: arranging a plurality of unit pixels in a matrix, and supplying a driving current to an EL element composing each of the pixels on the basis of scanning signals and digital image signals supplied in order to emit light and perform an image display. In this method, a plurality of current controlling elements are connected to a single EL element in the unit pixel and switched, corresponding to the condition of the scanning signal, between application and cutoff of the digital image signal with respect to the controlling terminals of the respective current controlling elements. Each of the current controlling elements is controlled by a voltage of the digital image signal applied to the controlling terminals so as to take an OFF state for cutting off a supply of the driving current to the EL elements or an ON state for supplying the EL elements with the driving current corresponding to the voltage of the digital image signal, thereby supplying the EL elements with a current of the sum value of the currents from the respective current controlling elements in the ON state. And a combination of the plural current controlling elements in the ON state is selected by the digital image signals so as to control the current supplied to the EL elements to be a value corresponding to the gradation to be displayed.

In the method, it is preferable to operate the current controlling elements in a linear operation region.

It is also preferable that the controlling voltage applied to the controlling terminals of the current controlling elements is determined to be at least 5 V

BRIEF DESCRIPTION OF DRAWINGS

FIG. 5 shows decoded content in a decoder in the block diagram.

FIG. 1A is a circuit diagram showing another structural example of an active matrix EL display device according to the fourth embodiment.

PREFERRED EMBODIMENT OF THE INVENTION

First Embodiment

Figure 1:
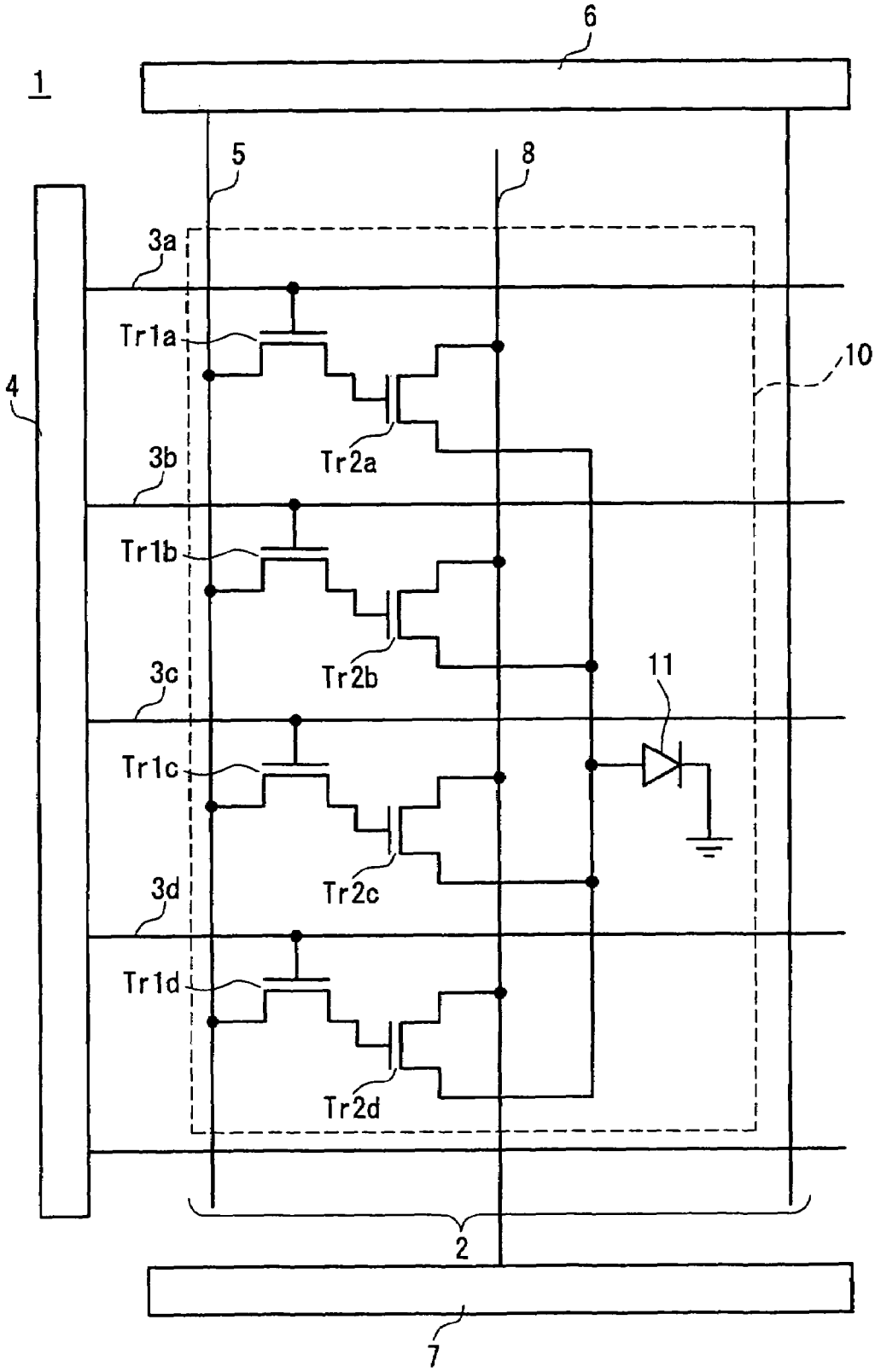
FIG. 1 is a circuit diagram showing a configuration of an active matrix EL display device according to a first embodiment of the present invention.

FIG. 1 shows a circuit structure of an active matrix EL display device, according to a first embodiment of the present invention. This EL display device 1 is based on a digital driving system for providing a gradation display by means of a digital image signal. The digital image signal is composed of 4 bit data, and it can provide 16-level gradation display.

A display portion 2 of the EL display device 1 is composed by arraying a plurality of unit pixels 10. Though plural unit pixels 10 are arrayed in a matrix in an actual device, only one unit pixel 10 is shown in FIG. 1 for the sake of clarity. Each unit pixel 10 has a single EL element 11 functioning as a light-emitter. Four driving transistors Tr2*a*–Tr2*d* as current controlling elements are arranged in each of the unit pixels 10, and either the source electrodes or the drain electrodes are connected to a pixel electrode composing the EL element 11. Either source electrodes or drain electrodes of switching transistors Tr1*a*–Tr1*d* composing a switching element are connected to the respective gates of the driving transistors Tr2*a*–Tr2*d*.

Each of the unit pixels 10 is driven by a scanning-driving circuit 4 for supplying a scanning signal, a signal-driving circuit 6 for supplying the image signal, and a current supply circuit 7 for supplying a current. A scanning signal from a scanning-driving circuit 4 is supplied to the gates of the switching transistors Tr1*a*–Tr1*d* through the respective scanning lines 3*a*–3*d*. The image signal from the signal-driving circuit 6 is supplied to each of the gates of the driving transistors Tr2*a*–Tr2*d* through the signal line 5 and the switching transistors Tr1*a*–Tr1*d*. The current supplied from the current supply circuit 7 is supplied to the pixel electrode of the EL element 11 through a current supply line 8 as a current supply bus line and the driving transistor Tr2*a*–Tr2*d*. Both the switching transistor Tr1*a*–Tr1*d* and the driving transistors Tr2*a*–Tr2*d* are thin film transistors (TFTs) of the same polarity, which are composed of P-channel type transistors in the first embodiment.

Figure 2:
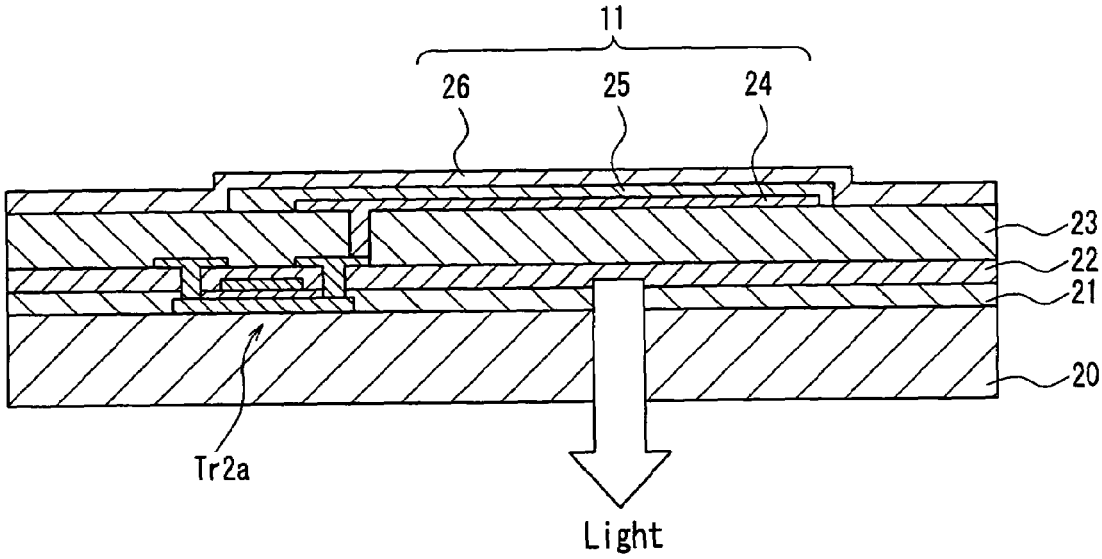
FIG. 2 is a cross-sectional view showing structures of an EL element and a driving transistor composing the EL display device.

FIG. 2 is a schematic cross-sectional view showing structures of the EL element 11 and the driving transistor Tr2*a*. The driving transistor Tr2*a* is shown as an example of the four driving transistors, and the remaining transistors are formed similarly. On a transparent substrate 20, the driving transistor Tr2*a* having a known structure is formed. A gate insulating film 21 is formed as an element for composing the driving transistor Tr2*a*. An interlayer insulating film 22 is formed to cover the driving transistor Tr2*a* and the gate insulating film 21, and the entire body is flattened by a flattening film 23.

The EL element 11 formed on the flattening film 23 is composed of a pixel electrode 24, an EL light-emitting layer 25 and a counter electrode 26 laminated in this order, where the EL light-emitting layer 25 is sandwiched between the pixel electrode 24 and the counter electrode 26. In this embodiment, the pixel electrode 24 and the counter electrode 26 correspond to an anodic electrode and a cathodic electrode, respectively. The pixel electrode 24 (anodic electrode) is a transparent electrode of, e.g., indium tin oxide (ITO) or the like, while the counter electrode 26 (cathodic electrode) is an opaque electrode. Therefore, light of the EL light-emitting layer 25 is irradiated from the side of the transparent substrate 20.

The EL element 11 can be an organic EL element or an inorganic EL element, and it can be configured to have a charge injection layer or a charge transportation layer. That is, the configuration shown in FIG. 2 is not limitative, but known EL elements can be used. The transparent substrate 20 is not limited specifically as long as it can support the EL element 11, and it can be made of a glass substrate or a resin film of polycarbonate, polymethyl methacrylate, polyethylene terephthalate or the like.

In the EL display device 1 of the above-described configuration, when a signal voltage corresponding to the image signal is applied to the signal line 5, switching transistors of lines applied with a scanning voltage are electrically conductive among the scanning lines 3*a*–3*d*, while the remaining switches are not conductive. Accordingly, any of the driving transistors Tr2*a*–Tr2*d* will be turned on only when it is connected to a conductive switching transistor, thereby supplying a current from the current supply line 8 to the EL element 11. In this manner, lines between the current supply line 8 and the EL element 11 compose a plurality of current supply branching lines.

The following description concerns a setting of the driving transistors Tr2*a*–Tr2*d*. The current driving abilities of the respective driving transistors Tr2*a*–Tr2*d* are set to predetermined values. In this embodiment, when the set values of the current driving abilities of the respective driving transistors are represented as Pa-Pd, Pa:Pb:Pc:Pd will be 1:2:4:8.

The current driving ability of a driving transistor can be decided by a gate width (μm) and a gate length (μm) of the driving transistor. Table 1 shows a relationship between current driving abilities of thin film transistors and gate width and gate length.

TABLE 1

| Driving transistor (current driving ability ratio) | Sizes of driving transistors | | |
|---|---|---|---|
| | W (gate width) | L (gate length) | W/L ratio |
| Tr2a(1) | 4 | 20 | 0.2 |
| Tr2b(2) | 4 | 10 | 0.4 |
| Tr2d(4) | 4 | 5 | 0.8 |
| Tr2d(8) | 8 | 5 | 1.6 |

As shown in Table 1, the current driving ability ratio of Pa:Pb:Pc:Pd can be set to 1:2:4:8 by determining the W/L ratio of the driving transistor Tr2*a* to be 0.2, the W/L ratio of the driving transistor Tr2*b* to be 0.4, the W/L ratio of the driving transistor Tr2*c* to be 0.8, and the W/L ratio of the driving transistor Tr2*d* to be 1.6. This ratio corresponds to weighting of the digital signal.

The next description concerns a driving condition for driving an EL display device in this embodiment. In this embodiment, when driving an EL display device, a driving transistor is driven under an operating condition for operating the driving transistor in a linear region, specifically for example, by setting the gate voltage to be 5 V or higher. By operating the driving transistor in a linear region in this manner, variation in the current value supplied to the EL element can be suppressed even if the threshold value of the driving transistor may vary. The detailed explanation will follow.

Figure 3A:
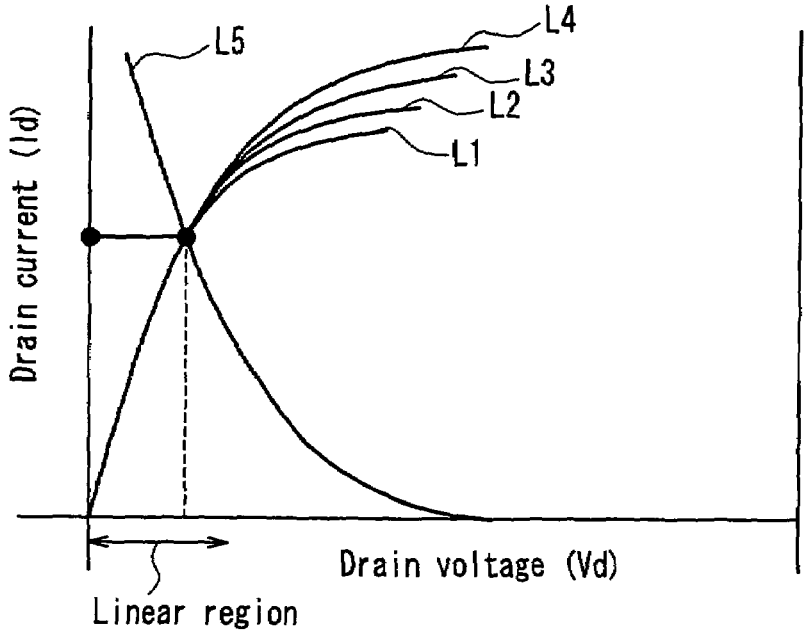
FIG. 3A is a graph to illustrate an operation region of a driving transistor composing the EL display device.
Figure 3B:
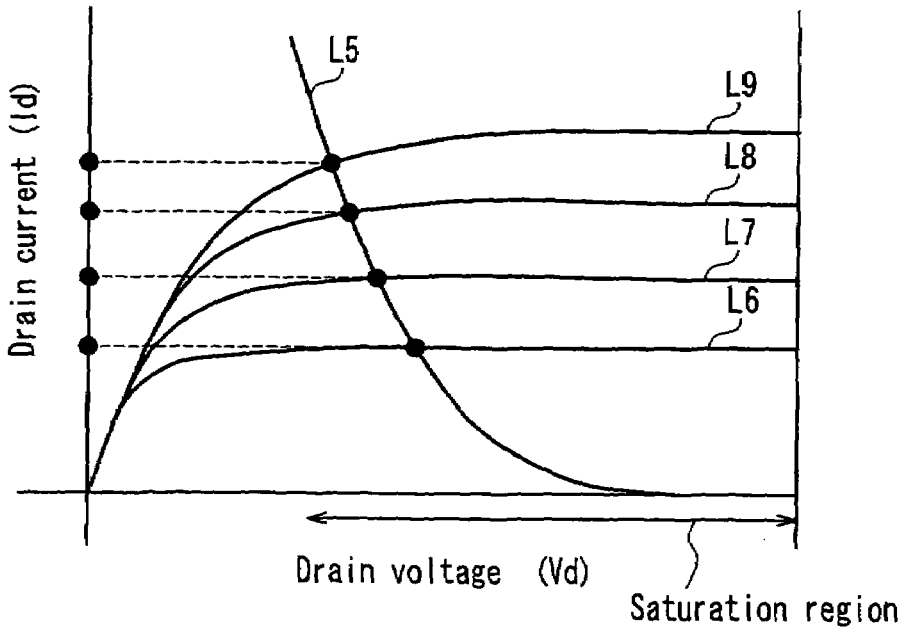
FIG. 3B is a graph to illustrate an operation region of a driving transistor composing a conventional EL display device.

FIGS. 3A and 3B are graphs for explaining an operation region of a driving transistor composing the active matrix EL display device. FIG. 3A shows a case of a driving transistor composing an active matrix EL display device according to the present invention, while FIG. 3B shows a driving transistor composing a conventional active matrix EL display device for comparison.

FIG. 3A shows a result of an operating point analysis for an EL element and a driving transistor for a case of providing a single EL element and a single driving transistor (P-channel type transistor) in a unit pixel. In FIG. 3A, a curve L5 denotes a voltage/current characteristic of the EL element, while curves L1–L4 denote (drain voltage)/(drain current) characteristics of the driving transistor. The curves L1, L2, L3 and L4 denote (drain voltage)/(drain current characteristics) for respective cases where the gate voltages are 5 V, 6 V, 7 V, and 8 V.

FIG. 3B shows a result of an operating point analysis for a conventional EL element and a driving transistor. In FIG. 3B, curves L6–L9 denote (drain voltage)/(drain current)

characteristics for the driving transistor. The curves L6, L7, L8, and L9 denote (drain voltage)/(drain current) characteristics for respective cases where the gate voltages are 1 V, 2 V, 3 V, and 4 V.

As shown in FIG. 3B, for a conventional case of gradation display of the active matrix EL display device, a voltage corresponding to the gradation is applied to the gate of the driving transistor while the driving transistor is driven under a condition so as to operate within a saturation region (right region in the figure). Under such a driving condition, when a low-temperature polysilicon is used for the driving transistor, since the threshold value of the driving transistor would vary in a range of ±0.2 V to 0.5 V, the ON current flowing in the driving transistor varies corresponding to that, so as to cause unevenness in the display. Namely, in a method of analogically displaying the gradation, the characteristics of the driving transistor must be controlled strictly.

According to the present invention, as shown in FIG. 3A, the gate voltage applied to the gate of the driving transistor is determined to be 5 V or higher, and the driving transistor is operated within the linear region left region in the figure). In this case, it is shown that the current value of the driving transistor at an intersection of the (drain voltage)/(drain current) characteristic of the driving transistor and the voltage/current characteristic of the EL element hardly will be influenced even when the gate voltage varies. Therefore, the driving transistor used here may be a transistor with inferior characteristics, which has been regarded as unsuitable due to the variation of the threshold value in a range of ±0.2 V to 0.5 V, causing variation in the gate voltage. This is particularly effective in a case of using polysilicon for forming a driving transistor. In this embodiment, a signal voltage of 5 V is applied via the signal line 5 to the gates of the driving transistors Tr2*a*–Tr2*d*.

Figure 4:
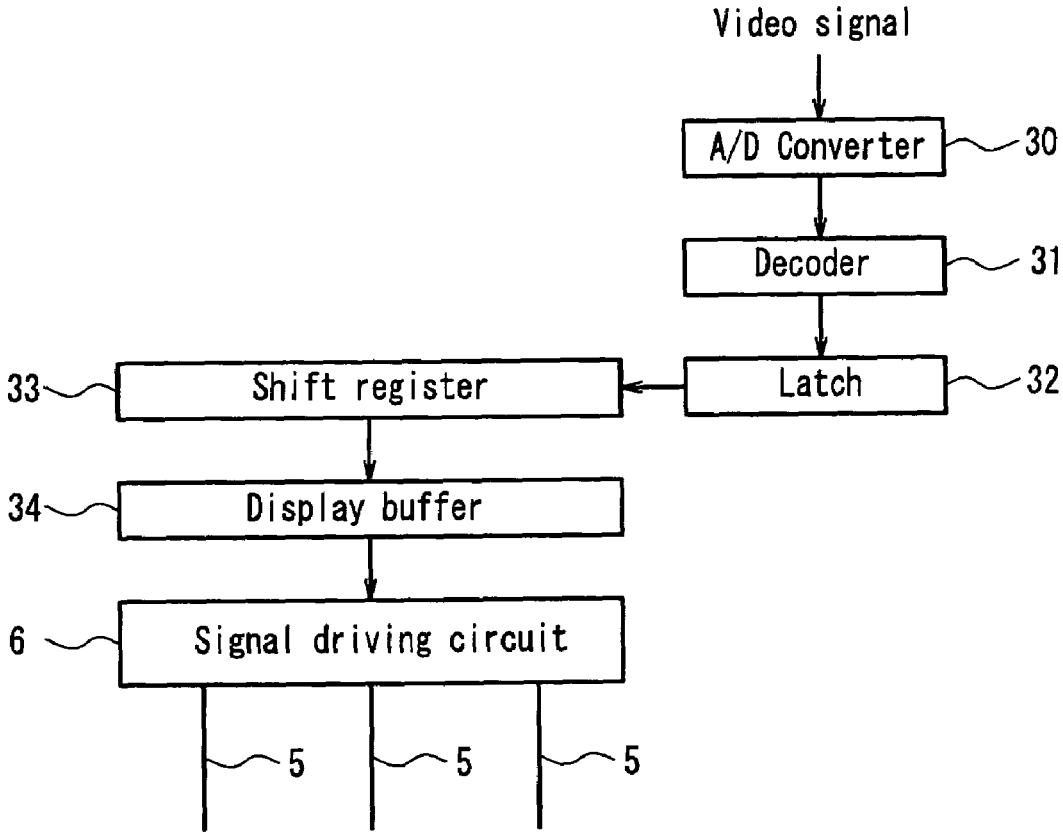
FIG. 4 is a block diagram showing a configuration of a part of a signal-driving circuit of an active matrix EL display device according to one embodiment of the present invention.

FIG. 4 is a block diagram showing a specific configuration of peripheral equipment of a signal-driving circuit. An image signal is converted by an A/D converter 30 to digital data, decoded to a 16-step gradation data of [0000](0) to [1111](15) by a decoder 31, latched by a latch 32, read by 1 bit each and shift-inputted sequentially into a shift register 33. When data for one horizontal scan are stored, the data are transmitted in parallel to a display buffer 34 and retained, and the respective bit data are applied as signal voltages to each of the driving transistors Tr2*a*–Tr2*d* via the signal-driving circuit 6 and the signal line 5.

FIG. 5 shows decoded contents in the decoder 31. In accordance with the ratio in the current driving abilities of the above-described driving transistors Tr2*a*–Tr2*d*, the data are decoded to provide binary data corresponding to the 16-step gradation in brightness.

In the signal-driving circuit 6, a voltage of 5 V is output as a signal voltage with respect to the '1' data, and a voltage of 0 V is output as a signal voltage with respect to the '0' data.

Next, operations of an active matrix EL display device in this embodiment will be described specifically by referring to FIG. 1.

When data of [0000] that are the lowest among the 16-step gradation data are provided, none of the driving transistors is driven, and thus the current flowing in the EL element 11 is zero, resulting in the darkest condition. When the gradation data becomes the gradation level of '1' as [1000], which is higher by 1 step, only the driving transistor Tr2*a* is turned on. In the gradation level '2' , of [0100] higher by 2 steps, only the driving transistor Tr2*b* is turned on. In this case, since the current driving ability of the driving transistor Tr2*b* is twice as high as that of the driving transistor Tr2*a*, the current value flowing into the EL element 11 is doubled. Furthermore, in the gradation level 3 of [1100] that is higher by 3 steps, the driving transistors Tr2*a* and Tr2*b* are turned on. In the gradation level 4 of [0010] that is higher by 4 steps, only the driving transistor Tr2*c* is turned on. In this case, since the current driving ability of the driving transistor Tr2*c* is four times that of the driving transistor Tr2*a*, the current value flowing into the EL element 11 is increased to four times.

In this manner, by varying the gradation level such as 0, 1, 2, 3 . . . , the gradation display of brightness can be provided. Since the current driving abilities of the driving transistors Tr2*a*–Tr2*d* are set corresponding to weighting of the digital signal, 16-step gradation display is provided corresponding to the digital image data.

As mentioned above, according to the embodiment, digital image signals are applied to a plurality of current controlling elements respectively through switching elements. And by selecting combinations of current controlling elements that are activated among the plural current controlling elements, a sum of output currents from plural current controlling elements is controlled corresponding to the gradation to be displayed, and a current corresponding to the gradation is supplied to the EL element. According to the configuration, a highly accurate gradation display with smaller variations is provided. In addition, degradation in an image caused by the occurrence of fixed patterns, which is observed in an area gradation method, can be averted.

Second Embodiment

Figure 6:
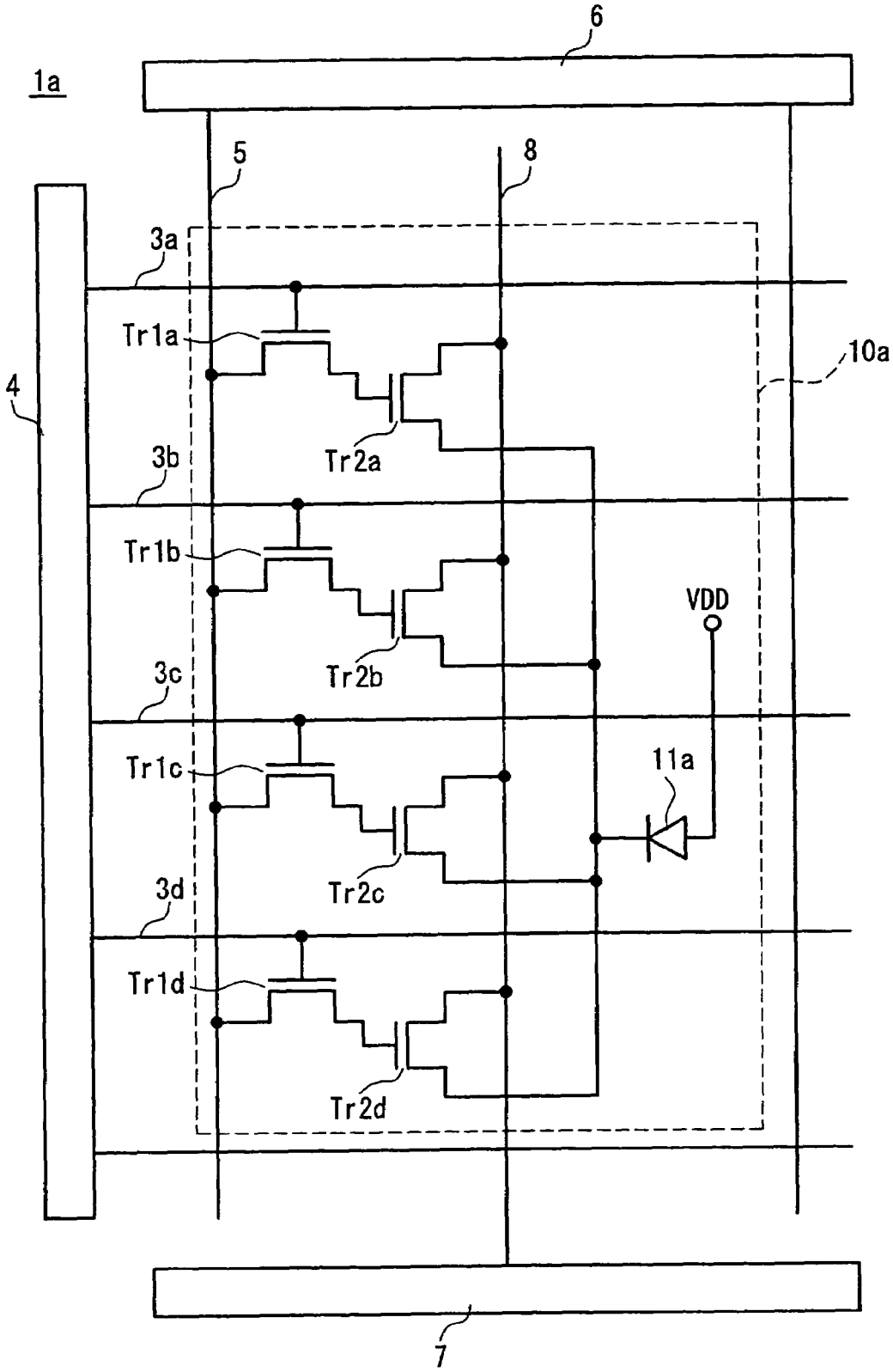
FIG. 6 is a circuit diagram showing a configuration of an active matrix EL display device according to a second embodiment of the present invention.

FIG. 6 shows a circuit structure of a unit pixel 10*a* of an active matrix EL display device la according to a second embodiment. Components that are the same as those of the EL display device shown in FIG. 1 are provided with identical reference numbers, and the description will not be repeated.

Figure 7:
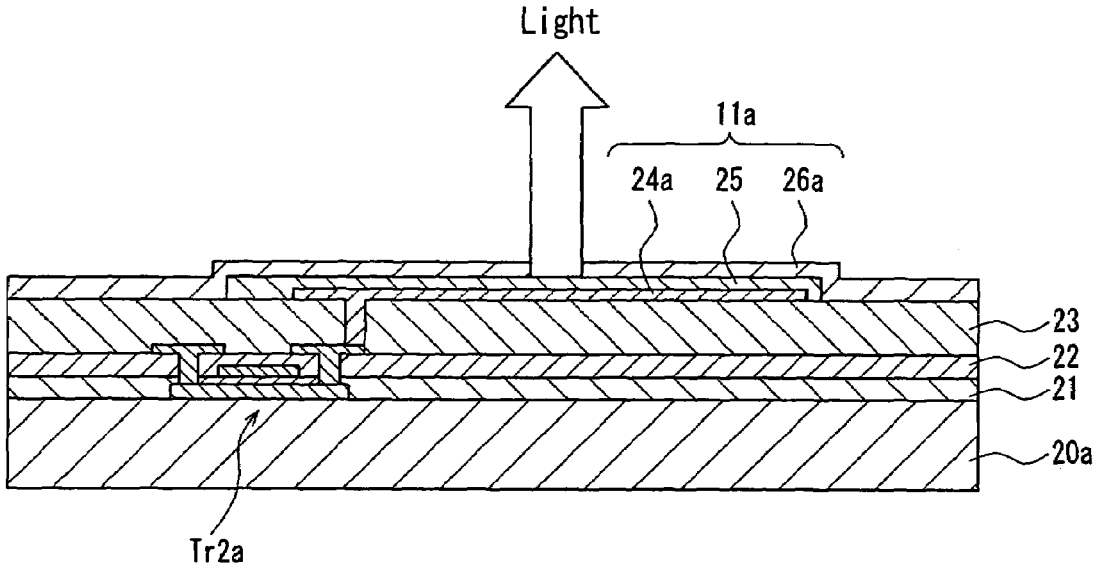
FIG. 7 is a cross-sectional view showing structures of an EL element and a driving transistor composing the EL display device.

In the second embodiment, both the switching transistors Tr1*a*–Tr1*d* and the driving transistors Tr2*a*–Tr2*d* are N-channel type transistors. A schematic structure of an EL element 11*a* and a driving transistor Tr2*a* is shown in FIG. 7. A pixel electrode 24*a* is a cathodic electrode of the EL element 11*a*, and a counter electrode 26*a* is an anodic electrode. The pixel electrode 24*a* as a cathodic electrode is an opaque electrode, while the counter electrode 26*a* as an anodic electrode is an ITO electrode. Excepting these, the configuration is identical to that of FIG. 1. In this configuration, light of the EL light-emitting layer 25 is irradiated from the direction opposite to the substrate 20*a*. Therefore, in the second embodiment, the substrate 20*a* is not limited to a transparent one, but an opaque substrate of silicon or the like can be used as well.

Though the driving transistor Tr2*a* can be a P-channel type transistor in a case of configuring the cathodic electrode of the EL element 11*a* as a pixel electrode 24*a* and the anodic electrode as a counter electrode 26*a*, use of the N-channel type transistor is desirable from the aspect of lowering the voltage. By making both the driving transistor and the switching transistor as N-channel type transistors, the voltages for the entire display device can be lowered.

The EL display device according to the second embodiment operates similarly to the first embodiment. Moreover, in this embodiment, the driving transistors and the switching transistors can be configured with transistors having different polarities.

Third Embodiment

Figure 8:
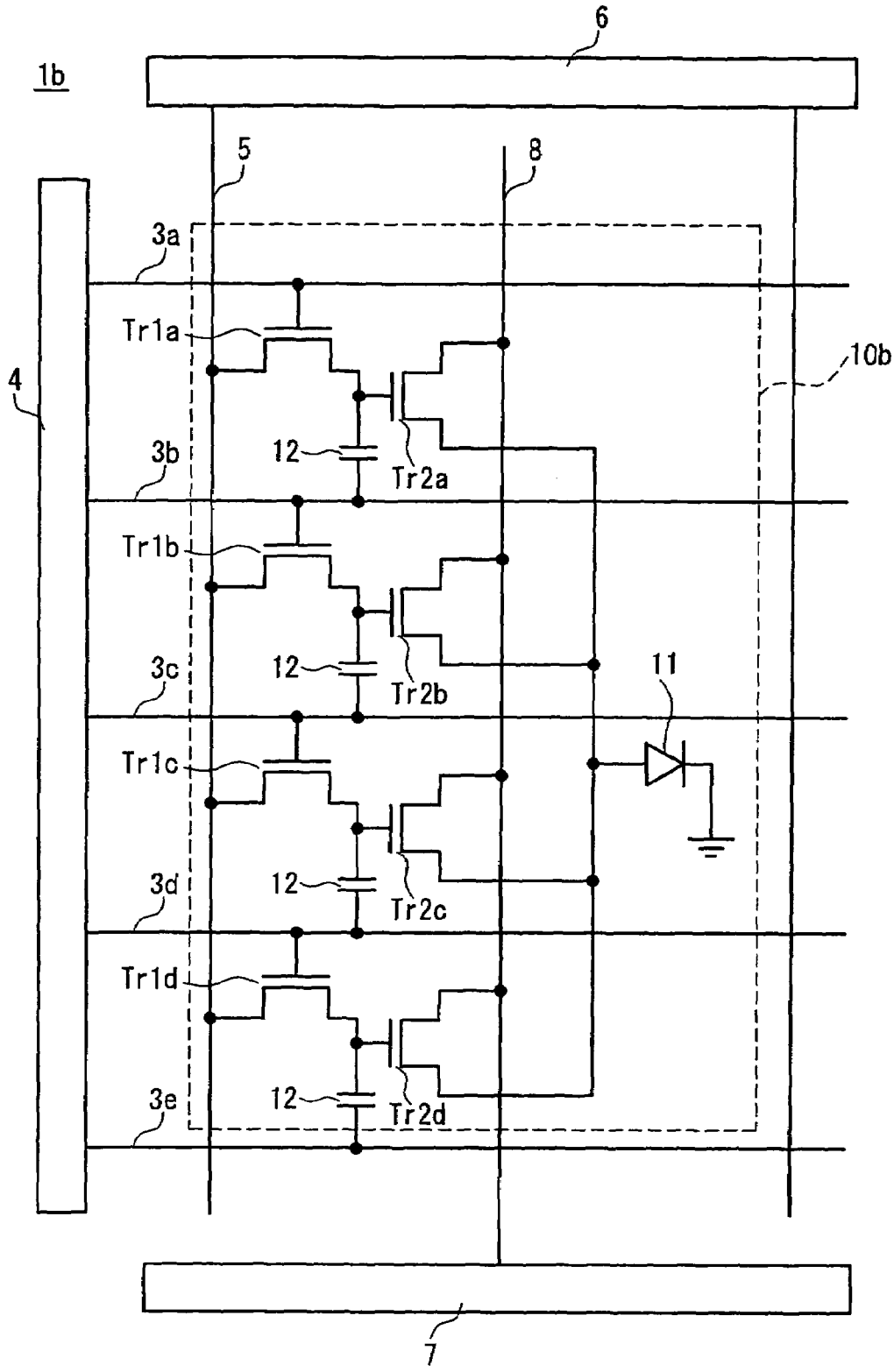
FIG. 8 is a circuit diagram showing a configuration of an active matrix EL display device according to a third embodiment of the present invention.

FIG. 8 shows a circuit structure of a unit pixel 10*b* of an active matrix EL display device 1*b* according to a third embodiment. Components that are the same as those of the EL display device shown in FIG. 1 are provided with identical reference numbers, and the description will not be repeated.

In this embodiment, an auxiliary capacitor 12 is provided between each of driving transistors Tr2*a*–Tr2*d* and each of scanning lines 3*b*–3*e* in the succeeding column. By providing the auxiliary capacitors 12, fluctuations in the gate voltages of the driving transistors Tr2*a*–Tr2*d* can be reduced. For example, when leakage current at the time that the switching transistors Tr1*a*–Tr1*d* are OFF is large, the gate voltages of the driving transistors Tr2*a*–Tr2*d* may vary. The auxiliary capacitors 12 are especially effective for such a case. The auxiliary capacitors 12 can have a common capacitance, or the capacitances can be set to a ratio corresponding to a ratio in the current driving ability of the driving transistors.

Figure 9:
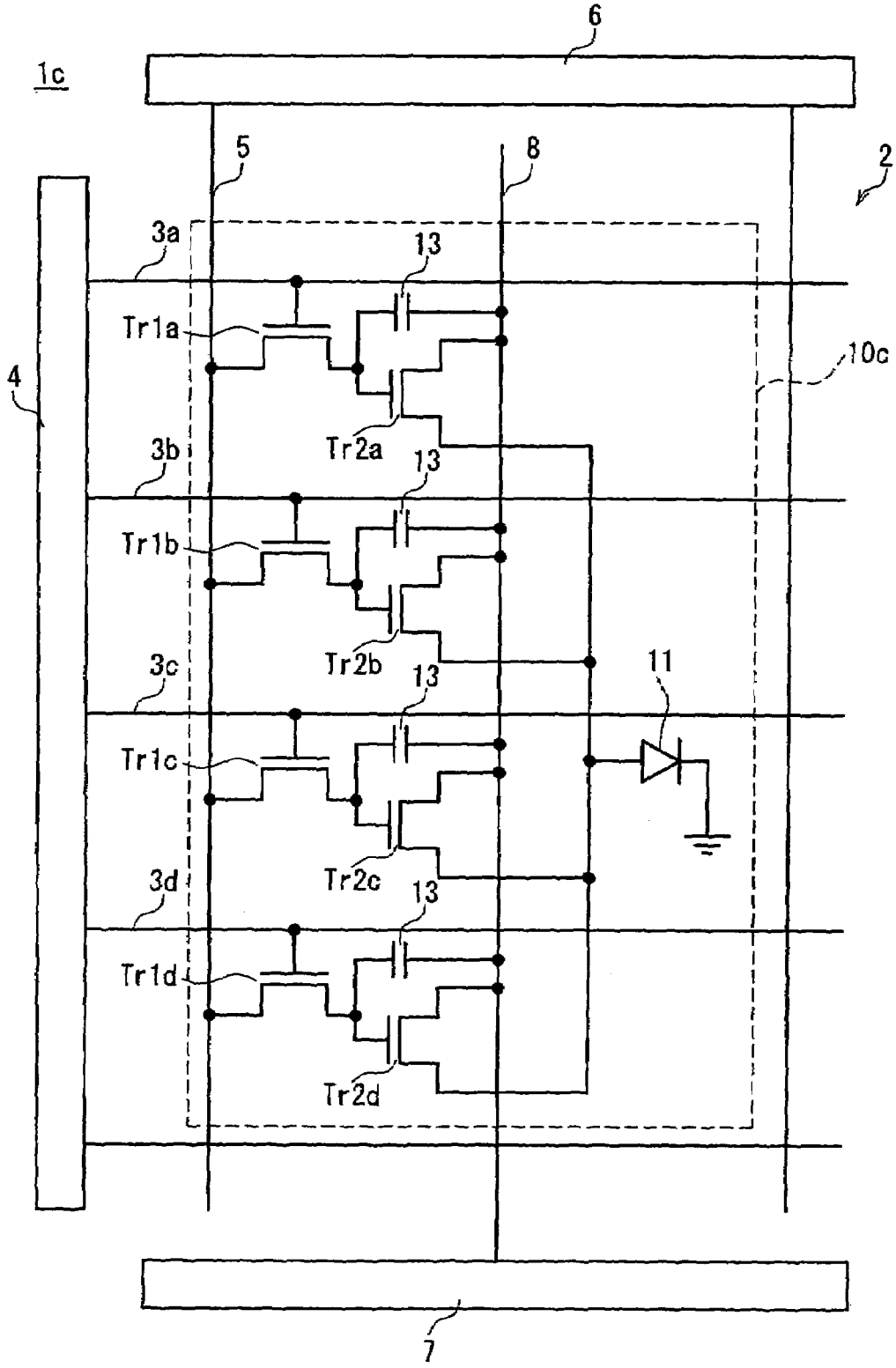
FIG. 9 is a circuit diagram showing another structural example of an active matrix EL display device according to the third embodiment.

Alternatively, a configuration of an EL display device 1*c* as shown in FIG. 9 can be applied as well. In the configuration, an auxiliary capacitor 13 is formed between each of the current supply lines 8 and each of the driving transistors Tr2*a*–Tr2*d*. This configuration similarly serves to suppress fluctuation in potentials of the current controlling elements, which is caused by leaks in the switching elements.

Fourth Embodiment

Figure 10A:
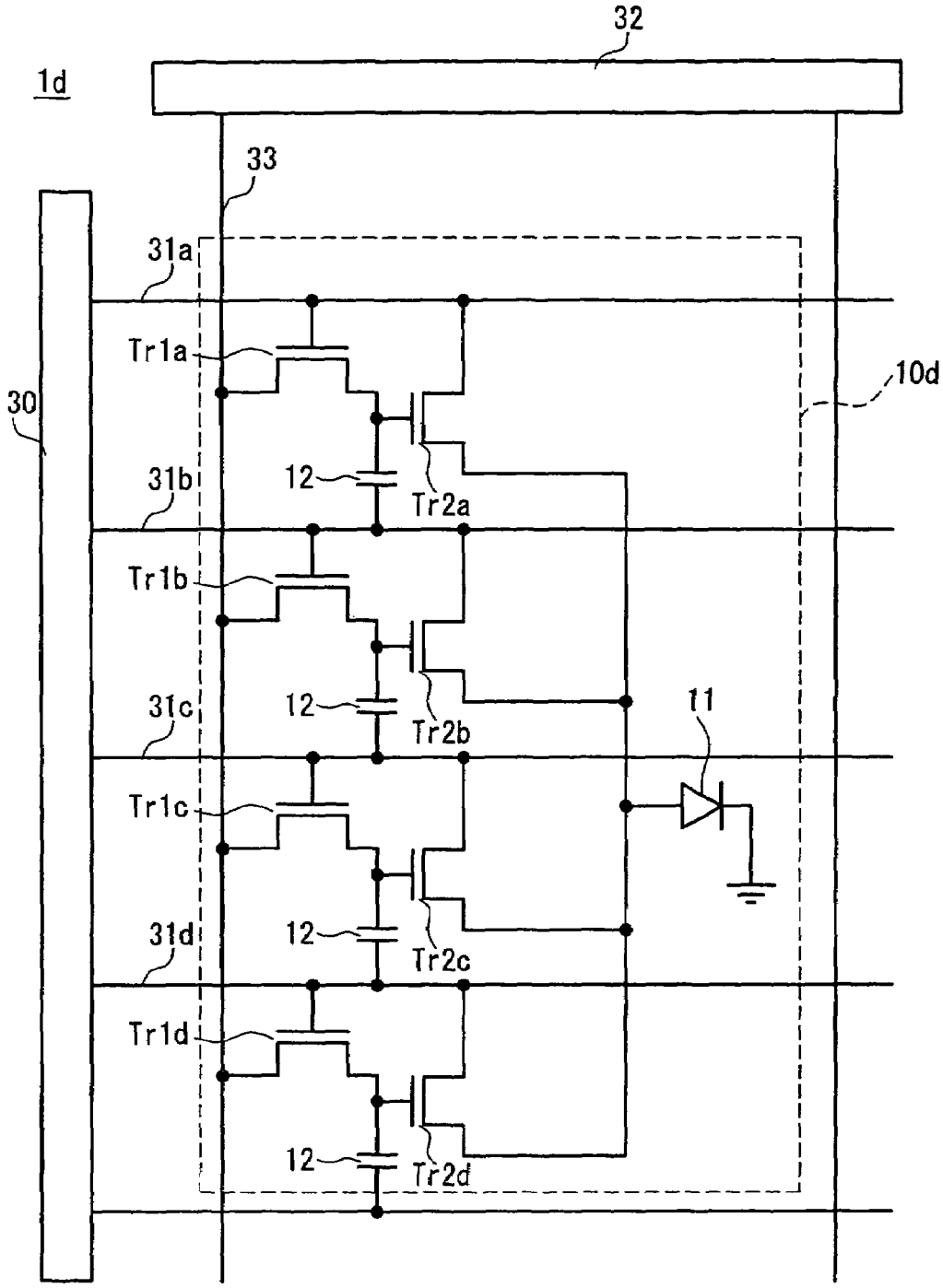
FIG. 10A is a circuit diagram showing a configuration of an active matrix EL display device according to a fourth embodiment of the present invention.

FIG. 10A shows a circuit structure of a unit pixel 10*d* of an active matrix EL display device 1*d* according to a fourth embodiment of the present invention. In the fourth embodiment, the configurations of the EL element 11, the switching transistors Tr1*a*–Tr1*d* and the driving transistors Tr2*a*–Tr2*d* are substantially the same as those of the EL display device 1 shown in FIG. 1. Therefore, the same components as those of the EL display device shown in FIG. 1 are provided with identical reference numbers, and the description will not be repeated. The relationship in the connection to a scanning-driving circuit 30, scanning lines 31*a*–31*d*, a signal-driving circuit 32 and a signal line 33 is the same as that in the EL display device 1 shown in FIG. 1. Furthermore, auxiliary capacitors 12 are provided similarly to the third embodiment shown in FIG. 8.

This embodiment is distinguished from the above embodiments in that the driving transistors Tr2*a*–Tr2*d* are connected respectively to the scanning lines 31*a*–31*d* at whichever of the source electrodes or the drain electrodes are not connected to the pixel electrodes of the EL element 11, while a dedicated current supply line is not provided. That is, the scanning lines 31*a*–31*d* have an additional function as current supply lines, and thus a driving current is supplied to the EL element 11 through the scanning lines 31*a*–31*d*.

Figure 10B:
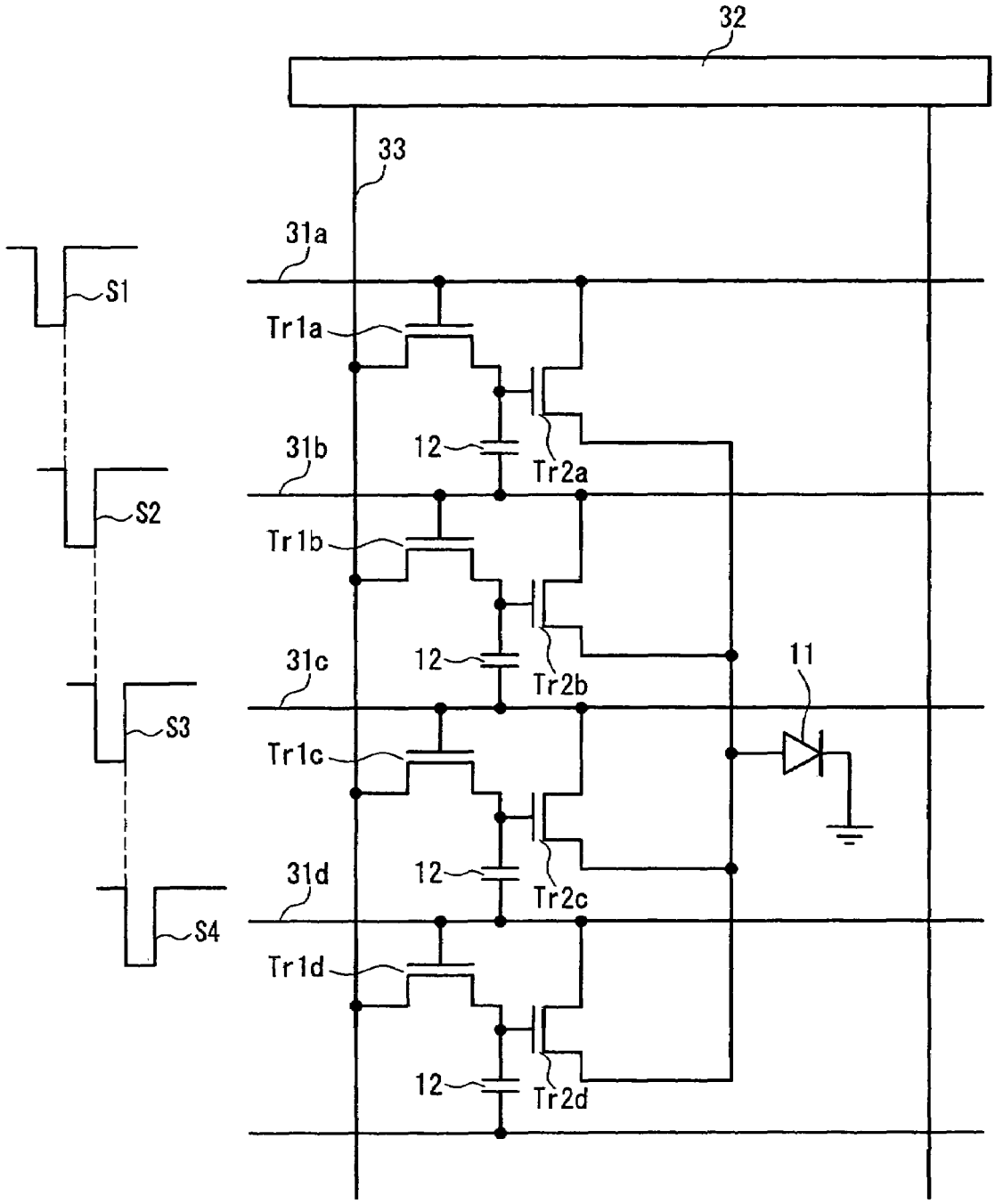
FIG. 10B is a view showing operations of the EL display device of FIG. 10A.

In the following, an operation of supplying a scanning signal and a driving current through the scanning lines 31*a*–31*d* in this circuit is explained by referring to FIG. 10B. First, when a scanning signal S1 is supplied to the scanning line 31*a* and the voltage level is lowered, the switching transistor Tr1*a* is turned on. Thereby, an image signal supplied through the signal line 33 is supplied to the gate of the driving transistor Tr2*a* and the charge is stored. When the supply of the scanning signal S1 finishes and the voltage of the scanning line 31*a* becomes high, the switching transistor Tr1*a* is turned off and the gate of the driving transistor Tr2*a* is maintained at a voltage corresponding to the image signal. Since the voltage of the scanning line 31*a* is at a high level, the driving transistor Tr2*a* supplies the EL element 11 with a current corresponding to the image signal.

Similar operations are repeated every time the scanning signals S2-S4 are supplied to the scanning lines 31*b*–31*d*.

By supplying driving current to the EL element 11 through the scanning lines 31*a*–31*d* in this manner, a dedicated current supply line can be omitted. The line breadth can be small between the scanning lines 31*a*–31*d* and the driving transistors Tr2*a*–Tr2*d* since the wiring is not a bus wiring like the current supply lines, and thus the line breadth forms a small portion with respect to the area of the unit pixel 10*d*. As a result, the numerical aperture is increased. Moreover, since the current supply line can be omitted, the occurrence of a short circuit between either the signal line or the scanning line and the current supply line can be avoided.

The auxiliary capacitor 12 is not an essential component in this embodiment, since a fixed voltage can be retained by gate capacitance of the driving transistors Tr2*a*–Tr2*d*. However, when there is a large leakage current at the time that the switching transistors Tr1*a*–Tr1*d* are OFF, it is preferred to provide auxiliary capacitors 12 for suppressing fluctuation in the gate voltages of the driving transistors Tr2*a*–Tr2*d*.

Figure 11A:
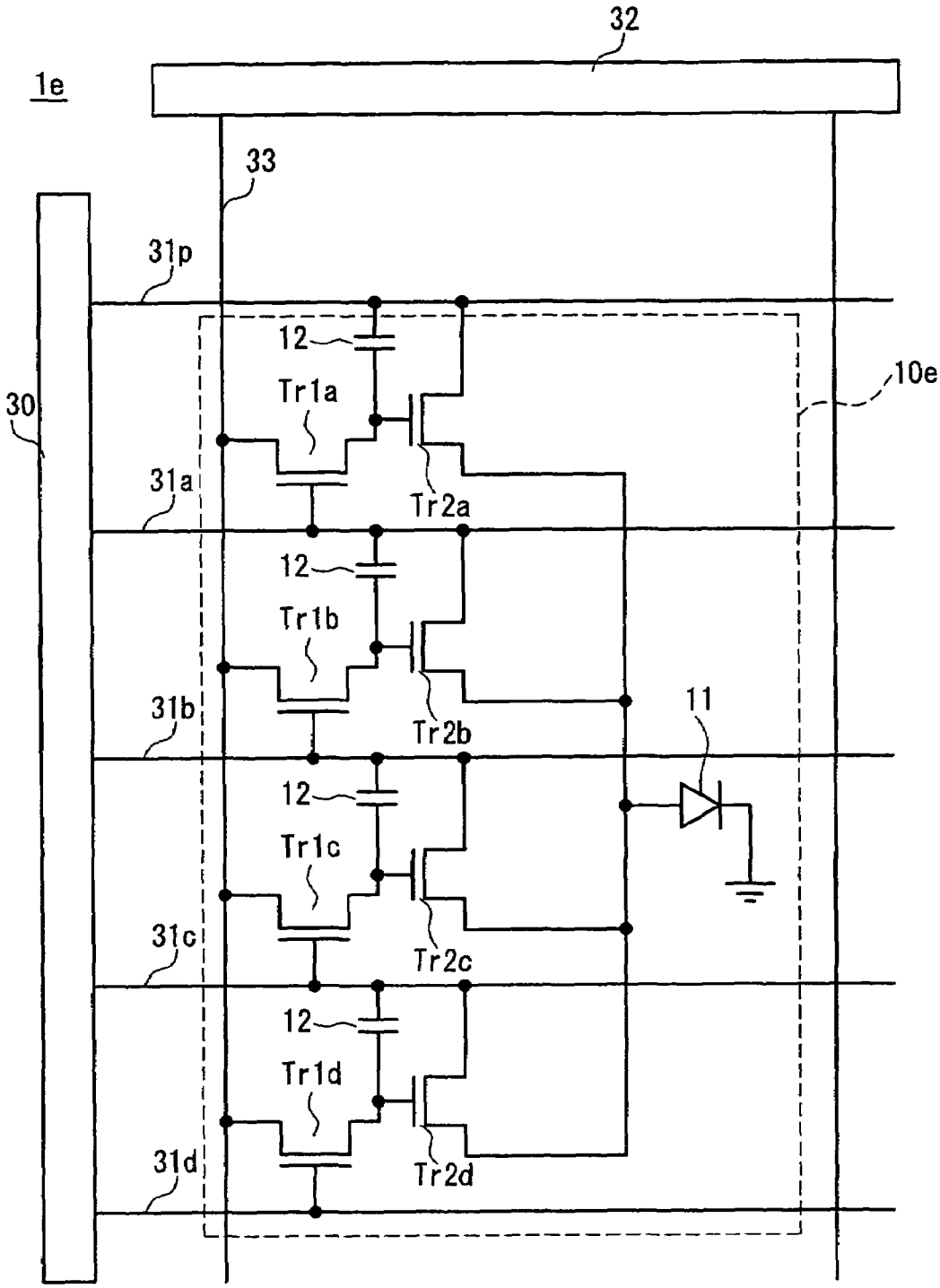
FIG. 11B is a view showing operations of the EL display device of FIG. 11A

Alternatively, the configuration of an EL display device le shown in FIG. 11A can be selected. In this configuration, as in the case of the display device in FIG. 10A, current is supplied to the driving transistors Tr2*a*–Tr2*d* in the unit pixel 10*e*, without using a dedicated current supply line. The EL display device can be distinguished from the display device in FIG. 10A in that scanning lines 31*p* and 31*a*–31*c* in the preceding column are used for the current supply lines while the scanning lines 31*a*–31*d* are used for supplying scanning signals to the switching transistors Tr1*a*–Tr1*d*. Here, the scanning line 31*p* denotes a scanning line in the unit pixel (not shown) in the preceding column. The auxiliary capacitors 12 are connected also between the scanning lines 31*p*, 31*a*–31*c* in the preceding column and the gates of the driving transistors Tr2*a*–Tr2*d*.

Figure 11B:
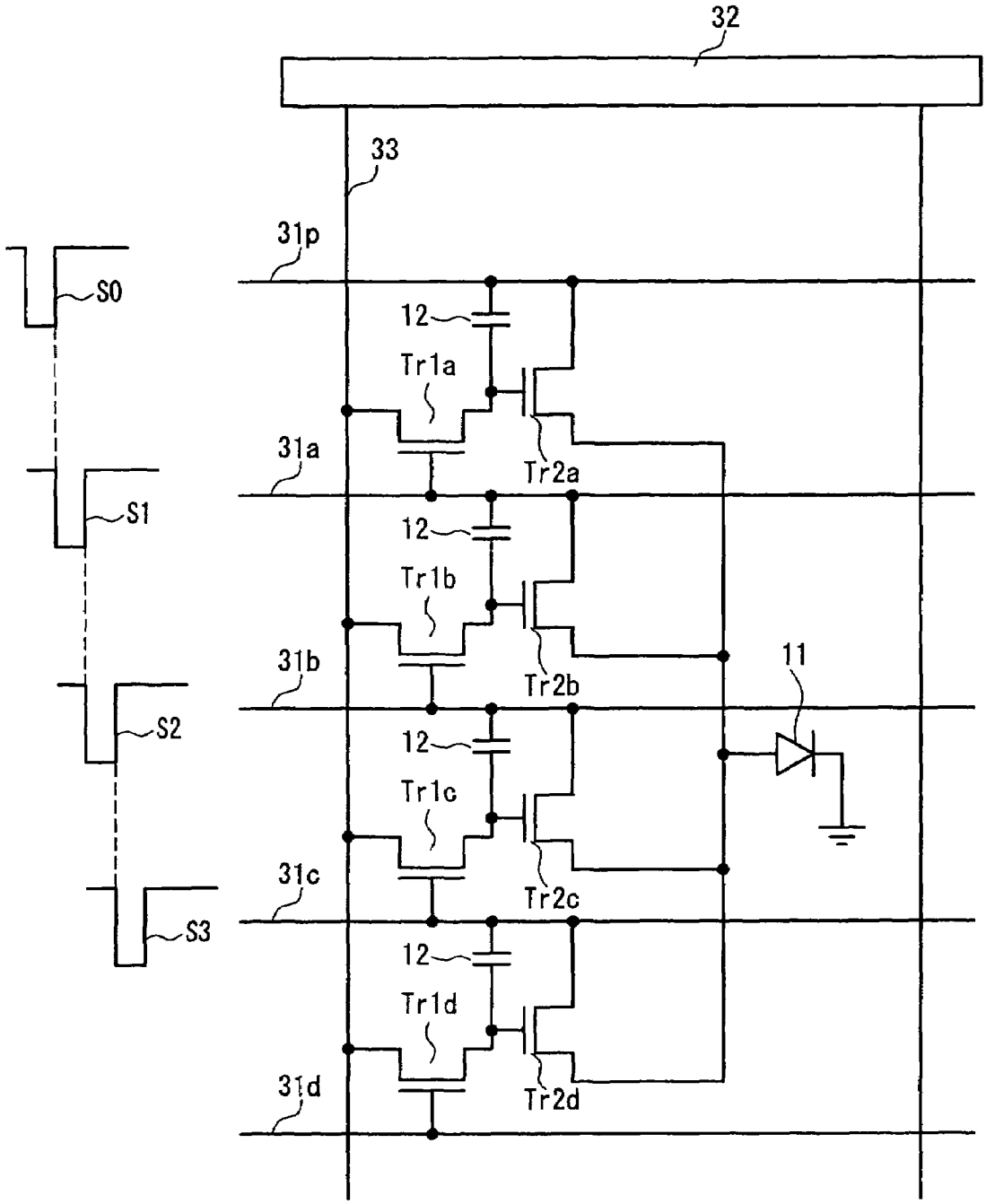
Figure 12:
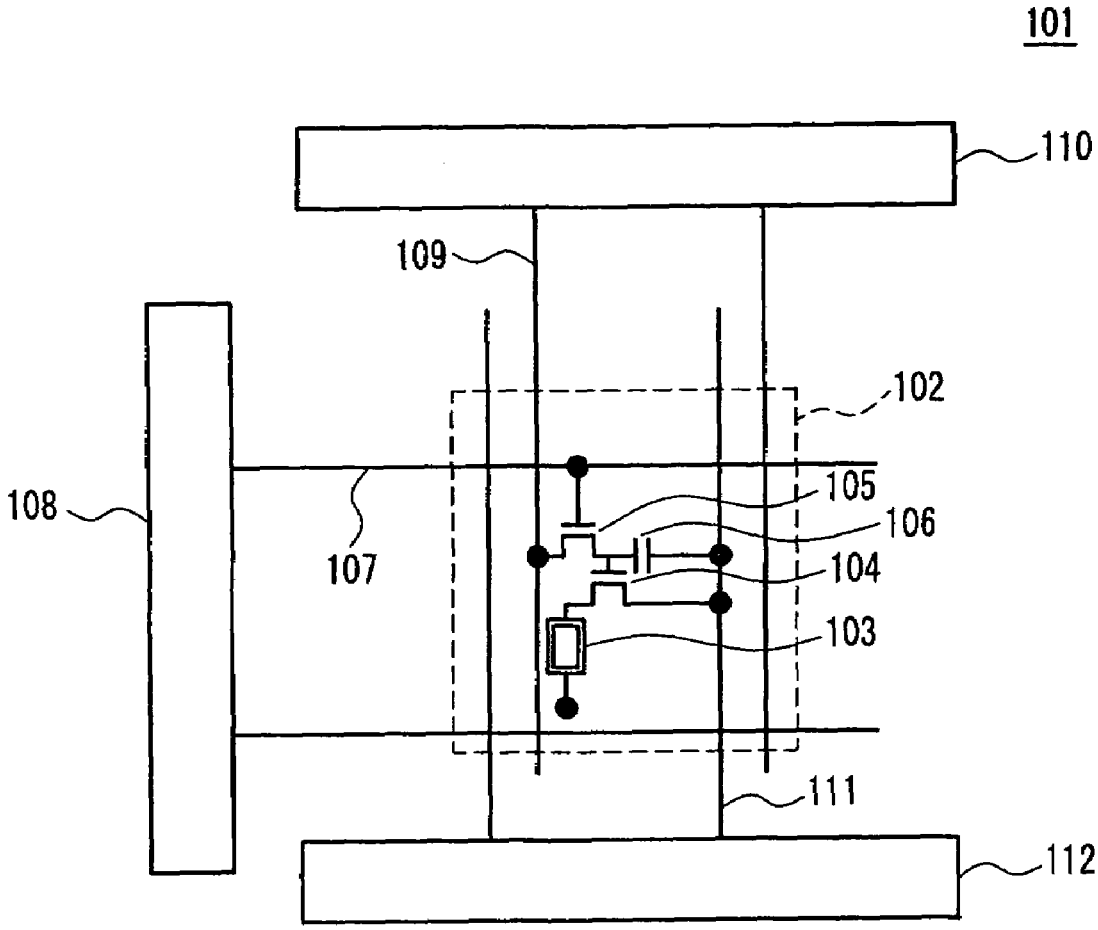
FIG. 12 is a circuit diagram showing a configuration of a conventional active matrix EL display device.

FIG. 11B is referred to for explanation of an operation in which the scanning signal and the driving signal are supplied through the scanning lines 31*p*, 31*a*–31*d* in this circuit. First, subsequent to a supply of a scanning signal SO to the scanning line 31*p*, the scanning line 31*p* is maintained at a high level voltage. Next, when scanning signal S1 is supplied to the scanning line 31*a* so that the voltage is decreased to a low level, the switching transistor Tr1*a* is turned on. Thereby an image signal supplied through the signal line 33 is supplied to the gate of the driving transistor Tr2*a* and charge is stored. When the supply of the scanning signal S1 finishes and the voltage of the scanning line 31*a* rises to a high level, the switching transistor Tr1*a* is turned off, and the gate of the driving transistor Tr2*a* is maintained at a voltage corresponding to the image signal. Since the voltage of the scanning line 31*p* is in a high level at this time, the driving transistor Tr2*a* supplies the EL element 11 with a current corresponding to the image signal. Similar operations are repeated for the scanning lines 31*b*–31*d*.

In the above embodiments, the explanation relates to a case where the image signal is determined as a 4-bit digital signal, and four driving transistors are used. The number of the driving transistors is decided corresponding to the number of the bits of the image signal and basically, it is equal to the number of the bits.

Alternatively, display can be performed by using a PWM driving method together in each of the configurations in the first to fourth embodiments. For example, for making the image signal to be 6-bit for displaying a 64-step gradation, six driving transistors must be used in the embodiment. This will increase the number of the transistors in the unit pixel, which will cause difficulty in the layout. For solving this problem, 4 bits (16-step gradation) of the 6 bits are displayed in a current gradation display method for controlling current value as in the first to fourth embodiments, and the remaining 2 bits (4-step gradation) are displayed in the PWM driving method. As a result of combining the current gradation display method and the PWM method in this manner, the layout is performed easily and a multi-gradation display of at least a 64-step gradation is available.

It is also possible to display by using together the configurations in the first to fourth embodiments and a spatial modulation gradation display method (error diffusion method; see for example, JP 08(1996)-286634A). Such driving methods are useful in preventing the occurrence of flicker so as to improve the image quality.

INDUSTRIAL APPLICABILITY

According to the present invention, as a current supplied to a single EL element is controlled by a plurality of current controlling elements for the purpose of gradation display, accurate gradation display is available without occurrence of fixed patterns. Moreover, it is easy to cope with variation in the threshold values of driving transistors composing the current controlling element.

The invention claimed is:

1. An active matrix EL display device comprising a plurality of unit pixels arranged in a matrix, each of the pixels having an EL element that is supplied with a driving current on the basis of a scanning signal and a digital image signal, so as to emit light and display an image, wherein the unit pixel comprises: a plurality of current controlling elements that have controlling terminals to which the respective digital image signals are applied and that are connected to a single EL element; and switching elements provided corresponding to the respective current controlling elements and supplied respectively with the scanning signal so as to switch between application and cutoff of the digital image signal with respect to the controlling terminals according to the condition of the scanning signal, each of the current controlling elements is controlled by a voltage of the digital image signal applied to the controlling terminals so as to take an OFF state for cutting off a supply of the driving current to the EL element or an ON state for supplying the EL element with the driving current corresponding to the voltage of the digital image signal, thereby a value of the current flowing in the EL element being the sum value of currents supplied from the respective current controlling elements in the ON state, and based on a combination of the current controlling elements in the ON state, the current supplied to the EL elements is controlled to be a value corresponding to the gradation to be displayed.

2. The active matrix EL display device according to claim 1, wherein a current driving ability of each of the plural current controlling elements is set to a value corresponding to weighting of each bit of the digital image signal.

3. The active matrix EL display device according to claim 2, wherein the number of the current controlling elements in the unit pixel is equal to the number of the bits of the digital image signal.

4. The active matrix EL display device according to claim 1, wherein the current controlling elements are thin film transistors.

5. The active matrix EL display device according to claim 4, wherein the thin film transistors are formed from polycrystalline silicon.

6. The active matrix EL display device according to claim 4, wherein a current driving ability X of the thin film transistors is set on the basis of a relationship represented by an equation:

$$X=(a\cdot W)/L$$

where 'a' denotes a constant, L denotes a gate length (μm) of the thin film transistors, and W denotes a gate width (μm) of the thin film transistors.

7. The active matrix EL display device according to claim 6, wherein the gate width W or the gate length L of the thin film transistors is set to be a size corresponding to weighting of each bit of the digital image signal.

8. The active matrix EL display device according to claim 1, wherein an auxiliary capacitor is connected to a controlling terminal of each of the current controlling elements.

9. The active matrix EL display device according to claim 8, wherein an auxiliary capacitor is formed between the controlling terminal of the current controlling element and the scanning line in either the preceding or succeeding column for supplying a scanning signal among the plural scanning lines.

10. The active matrix EL display device according to claim 8, the active matrix EL display device having a bus line for supplying exclusively a driving current to the EL elements via the current controlling element, and an auxiliary capacitor is formed between the controlling terminal of the current controlling element and the bus line for exclusively supplying the current.

11. The active matrix EL display device according to claim 1, wherein each of the current controlling elements is connected to a scanning line at a terminal other than the terminal connected to the EL element, and the scanning line is used also as a current supply line for supplying the driving current to the EL element via the current controlling element.

12. The active matrix EL display device according to claim 11, wherein each of the current controlling elements is connected to the scanning line corresponding to the current controlling elements in the preceding column.

13. A method of driving an active matrix EL display device, comprising:

arranging a plurality of unit pixels in a matrix, and supplying a driving current to an EL element composing each of the pixels on the basis of scanning signals and digital image signals supplied in order to emit light and perform an image display, wherein a plurality of current controlling elements are connected to a single EL element in the unit pixel and switched, corresponding to the condition of the scanning signal, between application and cutoff of the digital image signal with respect to the controlling terminals of the respective current controlling elements;

each of the current controlling elements is controlled by a voltage of the digital image signal applied to the controlling terminals so as to take an OFF state for cutting off a supply of the driving current to the EL elements or an ON state for supplying the EL elements with the driving current corresponding to the voltage of the digital image signal, thereby supplying the EL elements with a current of the sum value of the currents from the respective current controlling elements in the ON state; and a combination of the plural current controlling elements in the ON state is selected by the digital image signals so as to control the current supplied to the EL elements to be a value corresponding to the gradation to be displayed.

14. The method of driving an active matrix EL display device according to claim 13, wherein the current controlling elements are operated in a linear operation region.

15. The method of driving an active matrix EL display device according to claim 13, wherein a controlling voltage applied to the controlling terminals of the current controlling elements is at least 5 V.

* * * * *